US005929762A

United States Patent [19]

Missimer, Jr.

[11] Patent Number: 5,929,762

[45] Date of Patent: Jul. 27, 1999

[54] ELECTRICAL PANEL OVERTEMPERATURE ALARM SYSTEM

[75] Inventor: Richard S. Missimer, Jr., Mukwonago, Wis.

[73] Assignee: Reliance Controls Corp., Racine, Wis.

[21] Appl. No.: 08/959,475

[22] Filed: Oct. 28, 1997

[51] Int. Cl.[6] ..... G08B 17/06

[52] U.S. Cl. ..... 340/584; 340/594; 340/691.8; 340/693.5; 340/693.6

[58] Field of Search ..... 340/594, 584, 340/693, 691, 514, 693.5, 691.1, 691.8, 693.6

[56] References Cited

U.S. PATENT DOCUMENTS

| | | | |
|---|---|---|---|
| 4,660,027 | 4/1987 | Davis | 340/691 |
| 4,864,283 | 9/1989 | Seto | 340/691 |
| 4,962,373 | 10/1990 | Sirois | 340/693 |
| 5,461,367 | 10/1995 | Altavela et al. | 340/584 |

*Primary Examiner*—Glen Swann
*Attorney, Agent, or Firm*—Andrus, Sceales, Starke & Sawall

[57] ABSTRACT

A heat alarm for an electric panel cabinet that mounts a temperature sensor within the enclosed area defined by the cabinet and sounds an alarm if the temperature within the cabinet exceeds an upper temperature limit. The heat alarm includes a microprocessor that operates an audible alarm upon sensing an overheat condition. After operating the audible alarm for a continuous period of time, the microprocessor operates the audio alarm in a series of sound pulses separated by a silence interval. The silence interval increases as the continuous period during which the temperature in the electric panel exceeds the upper temperature limit increases. The heat alarm includes a manually operable alarm override device that can be depressed to deactivate the audible alarm for an override period to allow the home/business owner to address the overheat condition within the electric panel cabinet, without the distraction of the audible alarm.

22 Claims, 4 Drawing Sheets

ELECTRICAL PANEL OVERTEMPERATURE ALARM SYSTEM

BACKGROUND OF THE INVENTION

The present invention relates to a heat alarm for an electric panel cabinet. More specifically, the present invention relates to a battery powered heat alarm that includes a microprocessor controller that extends the life of the battery.

Electric panel cabinets typically house the main electric service panels or subpanels for the electric supply to a residential or commercial building. Electric panel cabinets typically contain many components that may overheat and start fires, such as feeder conductors, branch circuit conductors, circuit breakers, fuses, and bus bars. The overheating of one of these electrical components within the electric panel cabinet can be caused by many types malfunctions, such as loose or corroded connections, power overloads, or other malfunctions in the components themselves. When one of these electric components malfunctions, the large amount of voltage and current flowing through the components causes heat buildup within the cabinet and ultimately can ignite a fire within the cabinet, which then may spread to nearby building structural components and create a fire hazard.

Although smoke alarms are required to be in every residential or commercial building by the majority of local building codes, these smoke alarms often do not provide adequate protection against fires started in the electric panel cabinets. Specifically, smoke alarms are often not located near the electric panel cabinet, since the electric panel cabinet is typically located in a remote area of the building away from the normally occupied areas. Even if a smoke alarm is located near the electric panel cabinet, the smoke alarm typically reacts only after a fire has started and a sufficient amount of smoke has been produced. In an electric panel cabinet, an overheat condition may exist for hours or even days before smoke is present to trip a smoke alarm. Additionally, since many smoke alarms in commercial buildings are connected to the building's electrical system, a fire started in the electric panel cabinet can cause a loss of electric power, which then disables the smoke alarm.

Altavela et al. U.S. Pat. No. 5,461,367 teaches an electric panel heat alarm that responds to an overheat condition within an electric panel cabinet. The heat alarm disclosed in the '367 patent positions a heat sensor within the enclosed area defined by the cabinet and uses a battery power supply to activate an audible alarm when the temperature within the electric panel cabinet exceeds an upper temperature limit. While the alarm disclosed in the '367 patent operates sufficiently to indicate an overheat condition in the electric panel cabinet, the alarm of the '367 patent suffers from several drawbacks. Specifically, the alarm of the '367 patent is operated by a 9 volt battery in the event of an external power failure. If an overheat condition exists in the electric panel cabinet and the external power has been disrupted, the 9 volt battery continuously operates the audible alarm. However, since the audible alarm draws a relatively large amount of current when operating, the continuous operation of the audible alarm drains the battery power supply in a relatively short amount of time. Thus, if the home/business owner is away from the building, the audible alarm may not be heard before the battery power supply is completely drained. Because of the short battery life, the alarm disclosed in the '367 patent may fail to indicate to the home/business owner that an overheat condition exists in the electric panel cabinet.

It is therefore an object of the present invention to provide a heat alarm that responds to an overheat condition in an electric panel cabinet by activating an audible alarm. It is a further object of the invention to operate the audible alarm in a manner such that the life of the battery power supply is sufficiently extended such that the heat alarm notifies the home/business owner of the overheat condition even if the home/business owner is not present when the alarm initially activates.

It is a further object of the invention to provide a heat alarm having an override feature that allows the home/business owner to interrupt the activation of the audible alarm for an override period such that the home/business owner can attempt to remedy the overheat condition while the audible alarm is deactivated, thereby extending the battery life. It is another object of the invention to provide a visual indicator that continuously indicates that the electric panel is in an overheat condition, even during the override period when the audible alarm is deactivated.

BRIEF SUMMARY OF THE INVENTION

The present invention is a heat alarm for an electric panel cabinet that indicates an overheat condition exists within the enclosed area defined by the electric panel cabinet. The heat alarm of the invention includes a microprocessor controller that operates the heat alarm to extend the life of a battery power supply.

The heat alarm includes an enclosure that can be mounted to the electric panel cabinet such that a heat sensor extends from the enclosure into the electric panel cabinet. The heat alarm further includes a microprocessor and a battery power supply mounted within the enclosure. The microprocessor is operatively connected to the heat sensor, an audible alarm, a visual indicator, and a manually operable override device.

When the microprocessor determines that an overheat condition has occurred within the electric panel cabinet, the microprocessor activates the audible alarm to indicate that the temperature in the cabinet exceeds an upper temperature limit. After initially activating the audible alarm, the microprocessor monitors the continuous amount of time the temperature within the electric panel cabinet exceeds the upper temperature limit. As the continuous period of time the temperature exceeds the upper temperature limit increases, the microprocessor extends a silence interval between successive sound pulses, such that the amount of time between successive sound pulses becomes further apart the longer the temperature within the electric panel cabinet exceeds the upper temperature limit. In this manner, the microprocessor extends the life of the battery power supply.

If the manually operated override device is operated when the temperature within the electric panel cabinet exceeds the upper temperature limit, the microprocessor deactivates the audible alarm for an override period. The override period is a predetermined amount of time during which the activation of the audible alarm will be suspended such that the components within the electric panel cabinet can be examined. Since the home/business owner must manually operate the override device after hearing the audible alarm, suspension of the audible alarm during the override period extends the life of the battery while the home/business owner works on the electric cabinet. If the temperature within the electric panel cabinet remains above the upper temperature limit after the expiration of the override period, the audible alarm will again be activated. In this manner, the microprocessor of the heat alarm extends the battery life of the power supply.

In addition to the audible alarm, the microprocessor of the heat alarm activates a visual indicator at all times when the temperature within the electric panel cabinet exceeds the upper temperature limit. Unlike the audible alarm, the microprocessor continues to operate the visual indicator even after the manually operated alarm override device has been operated. Thus, the visual indicator is operated during the override period such that the home/business owner realizes the temperature within the electric panel cabinet exceeds the upper temperature limit during the override period. The visual indicator is also operated when the audible alarm is activated and during periods of silence between activation of the audible alarm. In this manner, the home/business owner is provided with a constant alarm indication when the temperature within the electric panel cabinet exceeds the upper temperature limit.

The heat alarm of the present invention extends the effective battery life of a battery power supply by extending the silence interval between consecutive sound pulses as the continuous period of time increases, during which the temperature within the enclosure defined by the electric panel cabinet is elevated. Additionally, the heat alarm of the present invention provides an override device that can be operated to suspend activation of the audible alarm for an override period such that the battery life is extended, and also provides a constant visual alarm indication.

Other features and advantages of the invention may be apparent to those skilled in the art upon inspecting the following drawings and description thereof.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
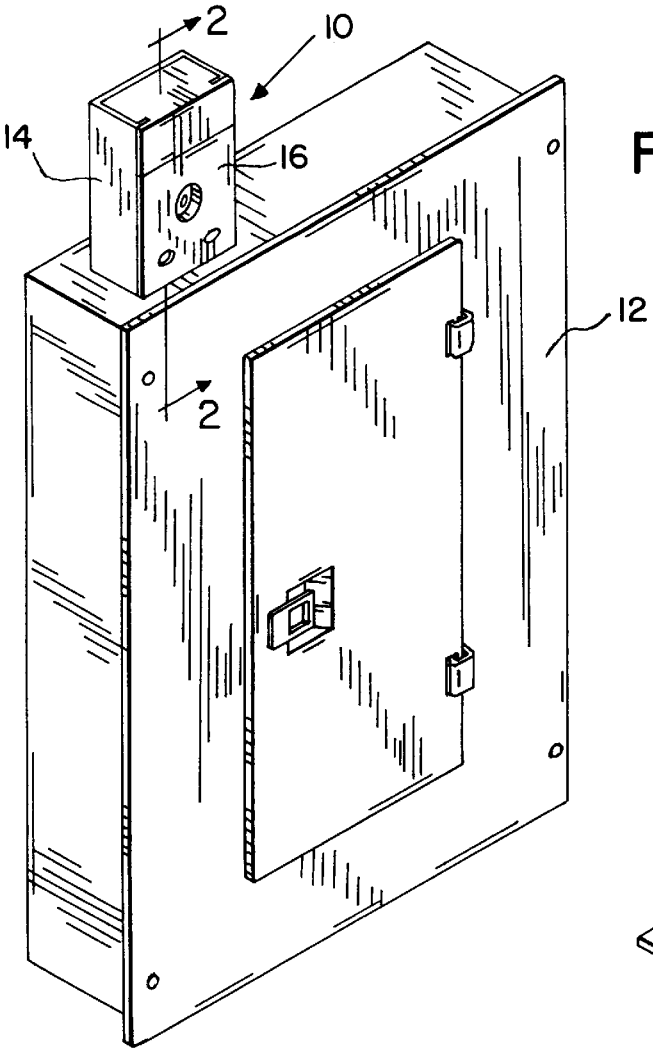
FIG. 1 is a general isometric view of the heat alarm of the present invention as mounted to an electric panel cabinet.

FIG. 1 shows a heat alarm 10 of the present invention as mounted to a conventional electric panel cabinet 12. The electric panel cabinet 12 typically encloses a variety of components used in routing electric power through a building, such as circuit breakers, fuses, and bus bars. Although the heat alarm 10 is shown as mounted to the top of the electric panel cabinet 12, the heat alarm 10 can be mounted to other areas of the cabinet 12, such as either one of the sidewalls or the front face.

Figure 4:
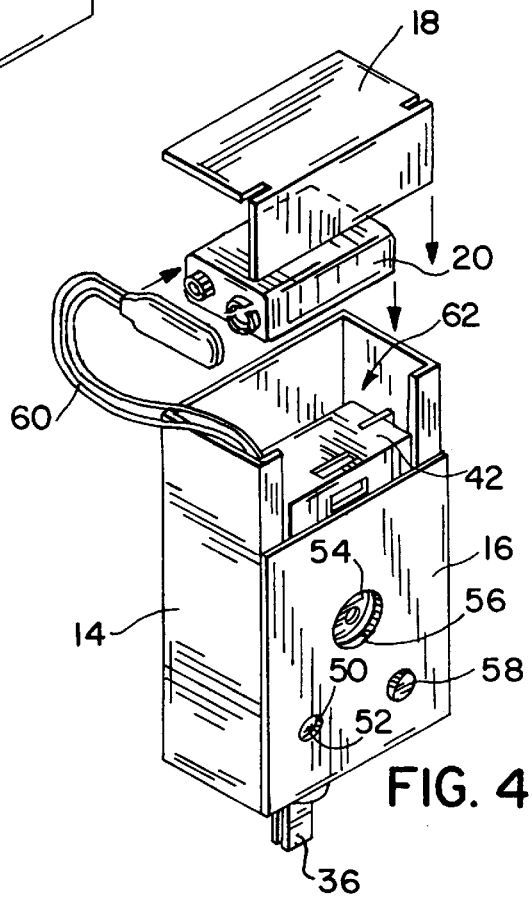
FIG. 4 is an exploded isometric view of the heat alarm of the present invention.

The heat alarm 10 generally includes a box-like enclosure 14 having a front face 16. As shown in FIG. 4, the enclosure 14 includes a removable battery cover 18 that provides access to a battery 20 mounted within the interior of the enclosure 14.

Figure 2:
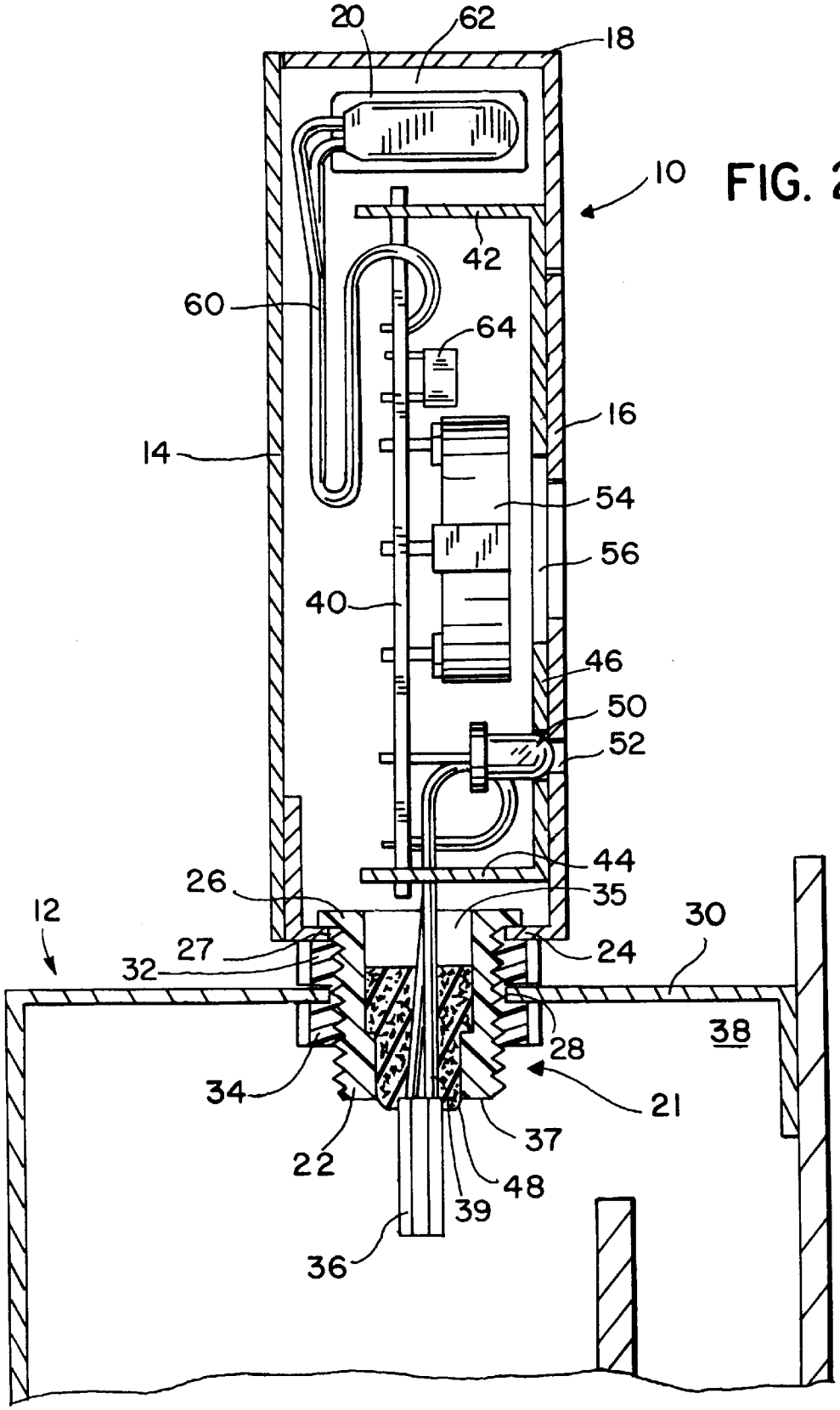
FIG. 2 is a sectional view taken along line 2—2 of FIG. 1 showing the internal components of the heat alarm of the present invention.

Referring now to FIG. 2, the heat alarm 10 includes a threaded rigid conduit nipple 22 extending through a bottom wall 24 of the enclosure 14. The nipple 22 includes a top flange 26 that prevents the nipple 22 from completely passing through an access opening 27 formed in the bottom wall 24. The heat alarm 10 is attached to the electric panel cabinet 12 by passing the threaded nipple 22 through a knockout opening 28 in a top wall 30 of the electric panel cabinet 12. An internally threaded upper lock nut 32 is positioned around the nipple 22 between the bottom wall 24 of the enclosure 14 and the top wall 30 of the electric panel cabinet 12. The upper lock nut 32 has a diameter greater than the diameter of the knockout opening 28, such that the upper lock nut 28 allows the enclosure 14 to sit slightly above the top wall 30 of the electric panel cabinet 12.

An internally threaded lower lock nut 34 surrounds the nipple 22 on the inside of the electric panel cabinet 12. The enclosure 14 is secured to the electric panel cabinet 12 by tightening the lower lock nut 34 along the threaded nipple 22 until the top wall 30 is securely clamped between the upper lock nut 32 and the lower lock nut 34. In the preferred embodiment of the invention, the top flange 26 is securely attached to the bottom wall 24 of the enclosure 14, such that the nipple 22 is fixed to the enclosure 14.

As can best be seen in FIG. 2, a bimetallic, single pole, closed-on-temperature rise heat sensor 36 passes through an internal passageway 35 formed in the nipple 22 and is disposed just below a lower edge 37 of the nipple 22. Thus, when the heat alarm 10 is positioned as shown in FIG. 2, the heat sensor 36 is disposed within an enclosed area 38 defined by the electric panel cabinet 12. The heat sensor 36 is connected by a pair of wires 39 to a circuit board 40. The circuit board 40 is securely retained within the enclosure 14 by a pair of support tabs 42 and 44 included on a support bracket 46. The support bracket 46 is securely mounted to the front face 16 of the enclosure 14 such that the support bracket 46 provides a secure point of attachment for the circuit board 40 and the components mounted thereto.

The heat sensor 36 is isolated from the threaded nipple 22 by an insulating member 48 positioned in the internal passageway 35, such that the material forming the nipple 22 does not affect the operation of the heat sensor 36. By connecting the heat alarm 10 to the electric panel cabinet 12 via the threaded nipple 22 extending through the knockout opening 28 in the top wall 30 of cabinet 12, the heat sensor 36 is disposed just inside of the electric panel cabinet 12. In this manner, the heat sensor 36 is positioned such that it can detect the temperature within the enclosed area 38 defined by cabinet 12 so that the heat alarm 10 can warn of an unsafe condition.

As can be seen in FIG. 2, various other components are mounted to the circuit board 40 within the enclosure 14. Specifically, a visual indicator 50 is connected to the circuit board 40. In the preferred embodiment of the invention, the visual indicator 50 is a red LED. The visual indicator 50 is aligned with an opening 52 in the front face 16 of the enclosure 14 such that the visual indicator 50 is visible from the exterior of the enclosure 14.

An audible alarm 54 is also connected to the circuit board 40. The audible alarm 54 is aligned with a sound opening 56 extending through both the front face 16 and the support bracket 46. The sound opening 56 allows sound generated by the audible alarm 54 to freely pass through the enclosure 14, such that the sound can be clearly heard.

Figure 3:
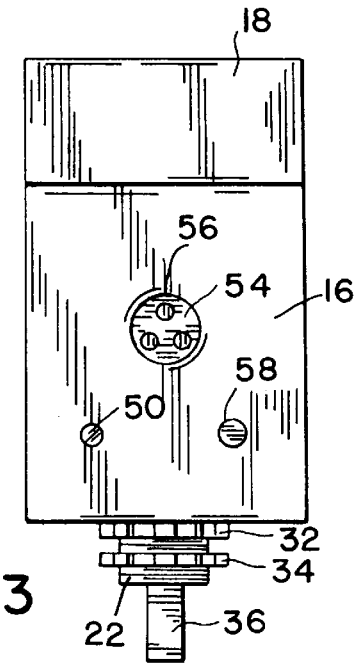
FIG. 3 is a front elevation view of the heat alarm of the present invention.

Although not shown in FIG. 2, a manually operable override device 58 (FIGS. 3, 4) is connected to the circuit board 40. The manually operable alarm override device 58 is accessible through the front face 16 of the enclosure 14, as shown in FIG. 4. In the preferred embodiment of the invention, the override device 58 is a conventional spring-loaded push-button switch that is spring biased into the open position.

As can best be seen in FIG. 2, the battery 20 is connected by a pair of leads 60 to the circuit board 40. The battery 20 is operatively connected via the circuit board 40 to provide the required power to operate the audible alarm 54 and the visual indicator 50. The battery 20 is contained within a battery chamber 62 defined by the support tab 42 and the battery cover 18, as best shown in FIG. 4. In this manner, the battery 20 can be replaced by simply removing the battery cover 18 and removing the battery 20 in a conventional manner.

A microprocessor 64 is connected to the circuit board 40 as is shown in FIG. 2. The microprocessor 64 is coupled to the battery 20, the heat sensor 36, the visual indicator 50, the audible alarm 54, and the override device 58 through the pre-printed circuit board 40. In this manner, the microprocessor 64 can control the operation of the entire heat alarm 10 in a manner as will be discussed. In the preferred embodiment of the invention, the microprocessor 64 is model number PIC16C54 as sold by Motorola. The microprocessor 64 was specifically selected because of its low power consumption in an attempt to extend the life of the battery 20. Although this microprocessor 64 was selected for the above-noted reason, other microprocessors could be substituted while operating within the scope of the invention.

Figure 5:
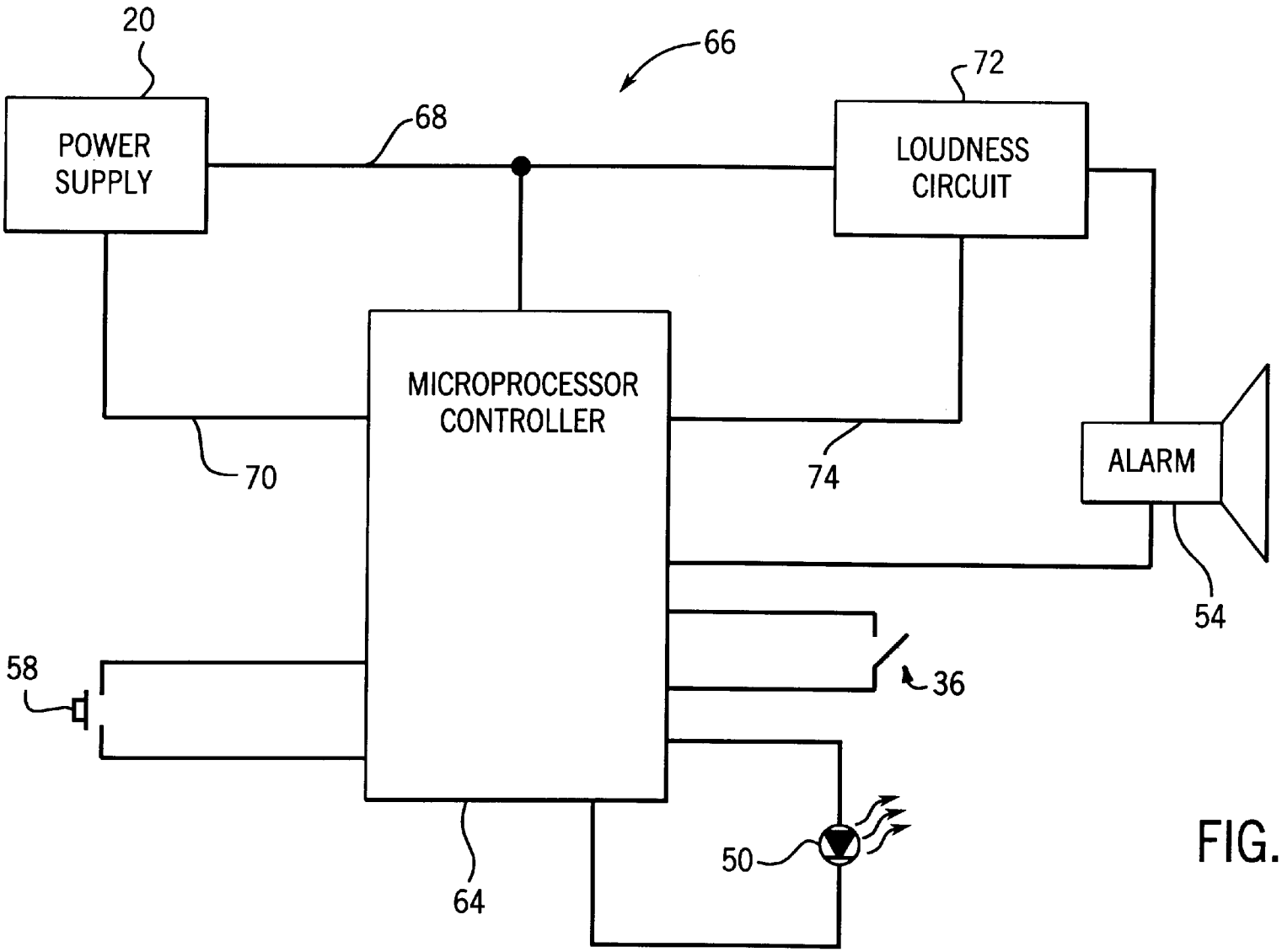
FIG. 5 is a schematic diagram of the electronic components of the heat alarm of the present invention.

Shown in FIG. 5 is a control circuit 66 incorporated into circuit board 40 and which operates the heat alarm 10. The control circuit 66 is centered around the microprocessor 64. The microprocessor 64 is connected to the push-button override device 58 such that when the override device 58 is closed, a signal is received by the microprocessor 64. The heat sensor 36 is also connected to the microprocessor controller. In FIG. 5, the heat sensor 36 is depicted as a bimetal switch that closes when the temperature within the electric panel cabinet 12 reaches a predetermined value. In the preferred embodiment of the invention, the heat sensor 36 is selected such that the bimetal switch closes when the temperature within the electric panel cabinet 12 reaches approximately 135° F., although it is understood that any other threshold temperature may be specified.

The battery 20 is connected to the microprocessor 64 by a power supply line 68. Through the power supply line 68, the microprocessor 64 receives the required power to operate. In the preferred embodiment of the invention, the battery 20 is connected to a voltage limiting circuit (not shown) such that the microprocessor 64 receives a constant voltage in its operating range which is 3 to 6 volts. The battery 20 is also connected to the microprocessor 64 through a low battery line 70 that allows the microprocessor 64 to monitor the voltage of the battery 20 and signal when the battery voltage drops below a minimum value.

The microprocessor 64 is connected to the audible alarm 54 as shown. The audible alarm 54 is also connected through a loudness circuit 72 to the battery 20. The loudness circuit 72 includes circuitry, known in the art, which increases the magnitude of the voltage supplied by the power supply, such that the loudness circuit 72 increases the volume of the audible alarm 54. In the preferred embodiment of the invention, the battery 20 is a 9 volt battery and the loudness circuit 72 steps the voltage from the battery 20 up to approximately 36 volts. Thus, the loudness of the audible alarm 54 can be greatly increased. In the preferred embodiment of the invention, the audible alarm 54 is operated at approximately 85 decibels. The microprocessor 64 is connected to the loudness circuit 72 through a control line 74 such that the microprocessor 64 can control the operation of the loudness circuit 72.

The visual indicator 50 is also connected to the microprocessor controller 64 as shown. As discussed, the visual indicator 50 is a red LED that emits light as shown in FIG. 5.

Figure 6:
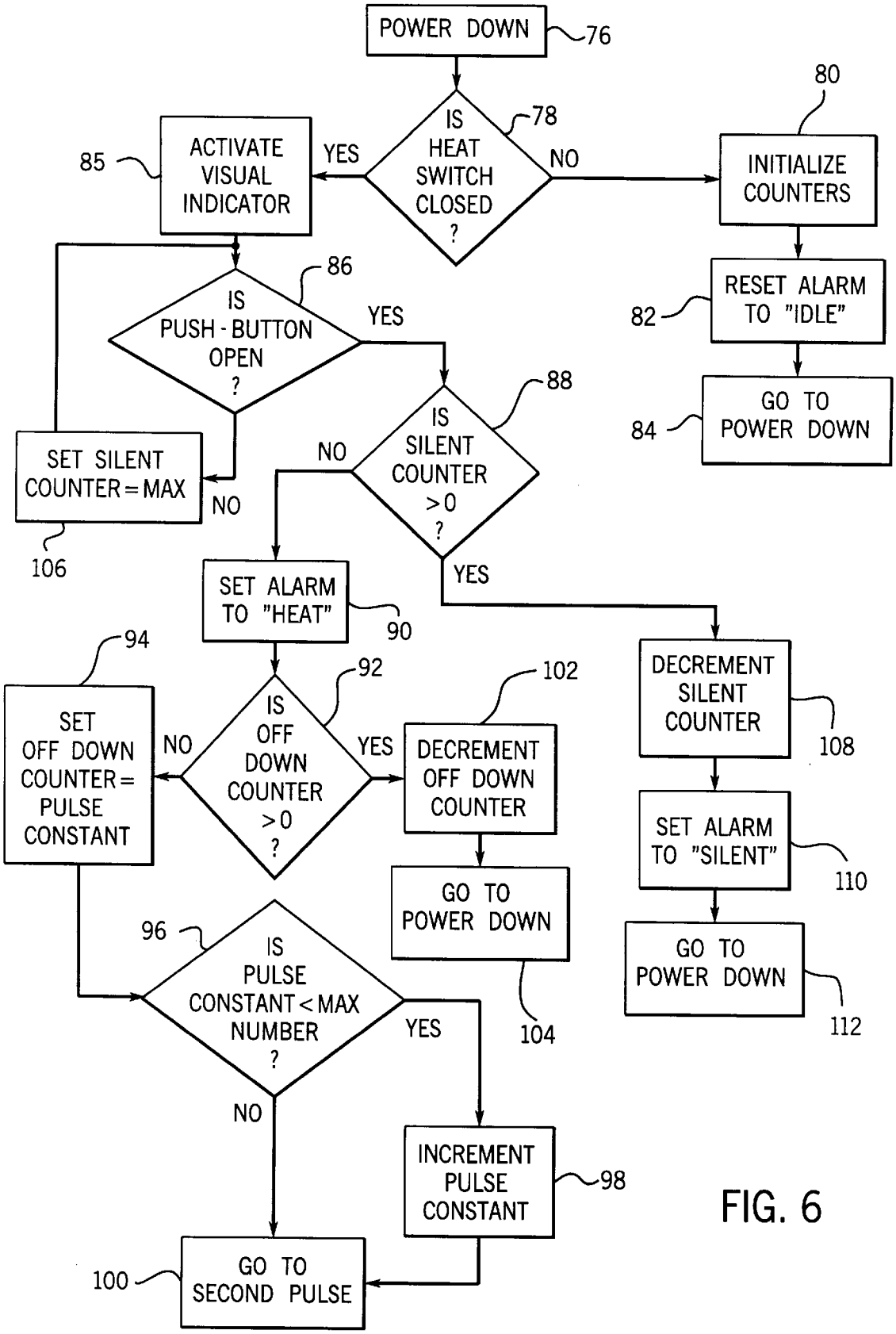
FIG. 6 is a flowchart depicting the operational steps performed by the microprocessor controller of the heat alarm of the present invention.

FIG. 6 shows the operating steps performed by the microprocessor 64 of the control circuit 66 in controlling the operation of the heat alarm 10 in the preferred embodiment of the invention. Although specific operating steps are shown in FIG. 6, it should be understood that the microprocessor 64 could be programmed in any of a number of manners while still operating within the scope of the present invention.

Although not shown in FIG. 6, when power is initially applied to the microprocessor 64, the microprocessor 64 performs a conventional initialization procedure, during which the memory locations within the microprocessor are initialized to a predetermined state. As shown in FIG. 6, the microprocessor 64 normally resides in a power-down state as shown by step 76. In the power-down state, the microprocessor 64 consumes a minimal amount of power by shutting down most of its internal processing capabilities while still being able to monitor several externally connected devices. If the microprocessor 64 detects that certain events have occurred, the microprocessor 64 leaves the power-down mode 76 and begins operating in a normal manner.

In the preferred embodiment shown in FIG. 6, the microprocessor 64 leaves the power-down state 76 whenever the heat sensor 36 detects an overheat condition. As discussed, the heat sensor 36 is a bimetal switch that closes when the temperature in the enclosed area 38 exceeds the upper temperature limit. As shown in step 78, whenever the switch in heat sensor 36 closes, the microprocessor 64 tests to determine if the heat sensor 36 is actually closed. To do this, the microprocessor 64 interrogates the heat sensor 36 several times to make sure that the switch is actually closed, thus preventing inadvertent momentary closures of the switch from activating the heat alarm 10. If the microprocessor 64 determines that the switch in the heat sensor 36 is not actually closed, the microprocessor 64 re-initializes all the counters within the microprocessor 64, as shown at step 80. Next, the microprocessor 64 will reset its alarm function to idle at step 82 and return to the power-down state, as shown at step 84. Since the microprocessor 64 received a false signal from the heat sensor 36, steps 80–84 allow the microprocessor 64 to reset its internal memory to a predetermined value such that the false closure of the switch in the heat sensor 36 does not affect future operation of the heat alarm 10.

If after interrogating the heat sensor 36 several times the microprocessor 64 determines at step 78 that the switch in the heat sensor 36 is closed, the microprocessor 64 actuates the visual indicator 50 at step 85. In the preferred embodiment of the invention, the LED visual indicator 50 is continuously flashed on and off by the microprocessor 64 at all times while the switch of heat sensor 36 remains closed. Next, the microprocessor 64 interrogates the override device 58 at step 86. As discussed, in the preferred embodiment of the invention the override device 58 is a push-button switch spring-biased into an open position.

If the push-button switch is open, the microprocessor 64 determines whether a silent counter is greater than zero at step 88. The silent counter is an internal counter within the microprocessor 64 that is initialized upon power-up to be equal to zero. Since the silent counter will be equal to zero the first time the switch in the heat sensor 36 closes, the microprocessor 64 sets its alarm memory location to the "heat" state at step 90.

After setting the alarm memory location to "heat", the microprocessor 64 determines whether an off-down counter is greater than zero at step 92. The off-down counter is another internal counter within the microprocessor 64. Initially, the off-down counter is initialized by the microprocessor 64 to be zero such that when the heat sensor 36 is closed for the first time due to an overheat condition within the enclosed area 38, the off-down counter is zero and the microprocessor 64 proceeds to step 94. In step 94, the microprocessor 64 sets the off-down counter equal to a pulse constant. The pulse constant is initialized by the microprocessor 64 to be a relatively low value such that the time period between successive alarm pulses is initially short, as will be discussed below.

After setting the off-down counter to equal the pulse constant at step 94, the microprocessor 64 determines at step 96 whether the pulse constant is less than a predetermined maximum amount. If the pulse constant is less than the maximum amount, as it will be during the initial closure of the switch in the heat sensor 36, the microprocessor 64 increments the pulse constant at step 98. By incrementing the pulse constant, the microprocessor 64 increases the amount of time between successive alarm pulses. After incrementing the pulse constant at step 98, or if the pulse constant is equal to the maximum number, the microprocessor 64 goes into a sound pulse subroutine.

Although the sound pulse subroutine is not shown, when the microprocessor 64 enters the sound pulse subroutine for the first time, the microprocessor operates the audible alarm 54 for a continuous period of time. In the preferred embodiment of the invention, when the switch in the heat sensor 36 initially closes, the microprocessor operates the audible alarm 54 for a continuous 4 to 5 minute interval.

After continuously operating the audible alarm 54 for the initial period, the microprocessor 64 returns to step 78 to determine if the switch within the heat sensor 36 is still closed. If the switch is still closed at step 78, the microprocessor 64 continues as previously discussed until it reaches step 92. At this time, the off-down counter will equal the pulse constant (step 94) such that the microprocessor 64 continues to step 102. In step 102, the microprocessor 64 decrements the off-down counter. After decrementing the off-down counter at step 102, the microprocessor returns to the power-down mode as shown at step 104. This process is repeated until the off-down counter is equal to zero at step 92. After the off-down counter equals zero, the microprocessor 64 sets the off-down counter to the incremented pulse constant at step 94. Again, if the pulse constant is less than the predetermined maximum number, the microprocessor increases the pulse constant at step 98 and goes to the sound pulse subroutine.

Since the switch in the heat sensor 36 has been on for a continuous period of time, the sound pulse subroutine will now generate only a sound pulse, rather than continuously operating the audible alarm 54. In the preferred embodiment of the invention, each of the sound pulses is an approximately one second interval during which the audible alarm 54 is activated. Thus, as can be understood in the flowchart of FIG. 6, the off-down counter is used as a delay mechanism to create a silence interval between successive sound pulses generated by the audible alarm 54. Each time through the subroutine, the off-down counter is set to be the pulse constant and the pulse constant is then increased. In this manner, the off-down counter is increased each time the microprocessor activates the audible alarm. Thus, the longer the switch in the heat sensor 36 remains closed, the longer the silence interval between the sound pulses will be. By increasing the silence interval between successive sound pulses, the microprocessor 64 extends the life of battery 20. Since the audible alarm 54 draws a significant amount of power each time it is operated, increasing the silence interval between sound pulses generated by the audible alarm 54 extends the life of battery 20.

The silence interval between successive sound pulses is limited by a maximum amount, as shown in step 96. Once the pulse constant reaches the maximum number, the pulse constant is no longer incremented and the sound pulses occur at the predetermined maximum silence interval. In the preferred embodiment of the invention, the maximum silence interval between sound pulses is approximately 20 seconds. By extending the silence interval between successive sound pulses, the microprocessor 64 extends the battery life such that the heat alarm 10 can more effectively indicate to a home/business owner that an overheat condition exists. In the prior heat alarms, a 9 volt battery 20 completely discharges in approximately 10 minutes. By utilizing the control circuit 66 including the microprocessor 64 of the present invention, the battery 20 can last as long as 100 hours.

Referring back to FIG. 6, if the home/business owner wishes to work on the electric components within the electric panel cabinet 12 while an overheat condition exists, the home/business owner can simply depress the manual override device 58. By depressing the override device 58, the home/business owner interrupts the activation of the audible alarm 54 for a predetermined override period. In the preferred embodiment of the invention, the override period is approximately 30 to 45 minutes, during which time activation of the audible alarm 54 is suspended. However, during this override period, the microprocessor 64 continues to flash the visual indicator 50 such that the home/business owner realizes that an overheat condition continues to exist within the electric panel cabinet 12. By suspending the operation of the audible alarm 54 for the override period, the microprocessor 64 not only extends the life of the battery 20, but also allows the home/business owner to work on the components within the electric panel cabinet 12 without the loud, annoying audible alarm 54 blaring in his or her ear.

Once the push-button override device 58 is depressed, the microprocessor 64 determines at step 86 that the push-button is no longer open. When the push-button override device 58 is closed, the microprocessor 64 sets an internal silent counter within the microprocessor 64 to a maximum amount at step 106. Once the silent counter is set to the maximum value at step 106, the microprocessor 64 again determines at step 86 if the push-button is open. After the push-button override device 58 returns to its spring-biased open position, the microprocessor determines whether the silent counter is greater than zero at step 88. Since the silent counter was set to the maximum amount at step 106, the microprocessor 64 decrements the silent counter in step 108. After decrementing the silent counter at step 108, the microprocessor sets the alarm memory location to "silent" at step 110. Next, the microprocessor 64 returns to the power-down mode at step 112. If the switch in the heat sensor 36 remains closed, the microprocessor 64 continues to decrement the silent counter until the silent counter equals zero.

Once the microprocessor 64 determines the silent counter equals zero at step 88, the microprocessor 64 will perform the steps previously described and eventually return to the sound pulse subroutine at step 100 to sound the audible alarm 54. As can be understood by the foregoing description, the silent counter is used by the microprocessor 64 to create the override period after the push-button override device 58 has been operated. During the override period, the operation of the audible alarm 54 is suspended, even though the temperature in the electric panel cabinet 12 exceeds the upper temperature limit. Since the silent counter is set to a maximum value in step 106, the override period is controlled by the value of the maximum amount for the silent counter. As can be understood in the flowchart of FIG. 6, the microprocessor 64 activates the visual indicator 50 whenever the switch in the heat sensor 36 is closed, regardless of the override period created by the silent counter.

The push-button override device 58 can also be used to test the audible alarm 54 when the temperature within the enclosed area 38 is below the upper temperature limit. When the override device 58 is depressed, the microprocessor 64 activates the audible alarm 54 as along as the push-button is closed. In this manner, the home/business owner can test the heat alarm 10.

In a preferred embodiment of the invention, the battery 20 is connected to the microprocessor 64 through a battery test line 70, as shown in FIG. 5. Included in the battery test line 70 is a switching device that closes when the battery voltage drops below a predetermined value. Once the battery voltage drops below the predetermined voltage, the microprocessor 64 operates the audible alarm 54 in a series of sound pulses that indicate a low battery condition.

It is recognized that various equivalents, alternatives and modifications to the invention as described are possible. Such equivalents, alternatives and modifications should be considered to fall within the scope of the following claims.

I claim:

1. A method of operating a heat alarm that responds to an overheat condition in an electric panel cabinet utilizing a heat sensor positioned in the cabinet for sensing the temperature therein, the method comprising the steps of:

activating an audible alarm when the heat sensor indicates that the temperature in the cabinet exceeds an upper temperature limit;

providing a manually operated alarm override device;

deactivating the audible alarm for an override period when the alarm override device is operated, the audible alarm being deactivated for the override period even if the temperature in the cabinet exceeds the upper temperature limit;

reactivating the audible alarm after the expiration of the override period if the temperature in the cabinet exceeds the upper temperature limit; and activating the audible alarm when the override device is operated and the temperature in the cabinet is below the upper temperature limit, such that the audible alarm can be tested by operating the alarm override device.

2. The method of claim 1 further comprising the step of coupling the heat sensor and the alarm override device to a microprocessor, the microprocessor generating the override period to deactivate the audible alarm after the alarm override device has been operated.

3. The method of claim 1 further comprising the step of activating a visual indicator when the heat sensor indicates that the temperature in the cabinet exceeds the upper temperature limit, the visual indicator remaining activated during the override period.

4. A method of operating a battery operated heat alarm that responds to an overheat condition in an electric panel cabinet utilizing a heat sensor positioned in the cabinet for indicating when the temperature within the cabinet exceeds an upper temperature limit, the method comprising the steps of:

activating an audible alarm responsive to the heat sensor whenever the temperature in the cabinet exceeds the upper temperature limit, the audible alarm being activated in a series of sound pulses each separated by a silence interval;

determining the continuous amount of time the audible alarm has been activated; and increasing the silence interval between the sound pulses as the continuous amount of time the audible alarm has been activated increases so as to extend the life of the battery.

5. The method of claim 4 wherein the length of the silence interval is limited to a maximum length.

6. The method of claim 4 further comprising the step of continuously activating the audible alarm for a continuous initial period immediately after the temperature in the cabinet exceeds the upper temperature limit, and activating the audible alarm in the series of sound pulses each separated by the silence interval after the initial period.

7. The method of claim 4 further comprising the step of activating a visual indicator when the temperature in the cabinet exceeds the upper temperature limit.

8. A method of operating a heat alarm that responds to an overheat condition in an electric panel cabinet utilizing a heat sensor positioned in the cabinet for indicating when the temperature within the cabinet exceeds an upper temperature limit, the method comprising:

activating an audible alarm whenever the heat sensor indicates that the temperature in the cabinet exceeds the upper temperature limit, the audible alarm being activated in a series of sound pulses each separated by a silence interval;

determining the continuous amount of time the audible alarm has been activated;

increasing the silence interval between the sound pulses as the continuous amount of time the audible alarm has been activated increases;

providing a manually operable alarm override device;

deactivating the audible alarm for an override period when the alarm override device is operated, the audible alarm being deactivated for the override period even if the temperature in the cabinet exceeds the upper temperature limit; and reactivating the audible alarm after the expiration of the override period if the temperature in the cabinet exceeds the upper temperature limit.

9. The method of claim 8 further comprising the step of continuously activating the audible alarm for a continuous initial period immediately after the temperature in the cabinet exceeds the upper temperature limit, and activating the audible alarm in the series of sound pulses each separated by the silence interval after the initial period.

10. The method of claim 8 further comprising the step of activating a visual indicator when the temperature in the cabinet exceeds the upper temperature limit, the visual indicator remaining activated during the override period.

11. The method of claim 8 wherein operating the alarm override device when the temperature in the cabinet is below the upper temperature limit activates the audible alarm, such that the audible alarm can be tested by operating the alarm override device.

12. The method of claim 8 further comprising the step of coupling a microprocessor to the heat sensor, the audible alarm, and the alarm override device, such that the microprocessor controls the operation of the audible alarm by generating the override period and increasing the silence interval between the sound pulses.

13. In a heat alarm for an electrical panel cabinet including an enclosure mountable to the cabinet, a power supply contained within the enclosure, and a heat sensor adapted to extend from the enclosure into the cabinet for indicating when the temperature in the cabinet exceeds an upper temperature limit, the improvement comprising:

a microprocessor mounted within the enclosure and coupled to the power supply and the heat sensor, the microprocessor controlling the operation of the heat alarm;

an audible alarm coupled to the microprocessor, the microprocessor activating the audible alarm in a series of sound pulses each separated by a silence interval whenever the temperature in the cabinet exceeds the upper temperature limit, wherein the microprocessor increases the silence interval between successive sound pulses based on the continuous amount of time that the temperature in the cabinet has exceeded the upper temperature limit; and a manually operable alarm override device coupled to the microprocessor such that the microprocessor deactivates the audible alarm for an override period after the alarm override device is operated.

14. In a heat alarm for an electrical panel cabinet including an enclosure mountable to the cabinet, a power supply contained within the enclosure, and a heat sensor adapted to extend from the enclosure into the cabinet for indicating when the temperature in the cabinet exceeds an upper temperature limit, the improvement comprising:

a microprocessor mounted within the enclosure and coupled to the power supply and the heat sensor, the microprocessor controlling the operation of the heat alarm;

an audible alarm coupled to the microprocessor, the microprocessor activating the audible alarm in a series of sound pulses each separated by a silence interval whenever the temperature in the cabinet exceeds the upper temperature limit;

a manually operable alarm override device coupled to the microprocessor such that the microprocessor deactivates the audible alarm for an override period after the alarm override device is operated, wherein the manually operable alarm override device activates the audible alarm when the alarm override device is operated and the temperature in the electric panel is below the upper temperature limit, such that the audible alarm can be tested.

15. The improvement of claim 14 wherein the manually operated alarm override device is a push-button switch.

16. The improvement of claim 14 further comprising a visual indicator coupled to the microprocessor, the microprocessor activating the visual indicator whenever the temperature in the cabinet exceeds the upper temperature limit, wherein the microprocessor continues to operate the visual indicator during the override period.

17. In a heat alarm for an electric panel cabinet including an enclosure mountable to the cabinet, a power supply contained within the enclosure, and a heat sensor adapted to extend from the enclosure into the cabinet for indicating when the temperature in the cabinet exceeds an upper temperature limit, the improvement comprising:

a microprocessor mounted within the enclosure and coupled to the power supply and the heat sensor, the microprocessor controlling the operation of the heat alarm; and an audible alarm coupled to the microprocessor, the microprocessor activating the audible alarm in a series of sound pulses each separated by a silence interval whenever the temperature in the electric panel exceeds the upper temperature limit, wherein the microprocessor extends the silence interval between successive sound pulses based on the continuous amount of time that the temperature in the cabinet has exceeded the upper temperature limit.

18. The improvement of claim 17 wherein the power supply is a battery, such that the microprocessor extends the battery life by extending the silence interval between sound pulses when the temperature in the electric panel exceeds the upper temperature limit for a continuous amount of time.

19. The improvement of claim 17 further comprising a manually operable alarm override device coupled to the microprocessor such that the microprocessor deactivates the audible alarm for an override period after the alarm override device is operated.

20. The improvement of claim 19 further comprising a visual indicator coupled to the microprocessor, the microprocessor operating the visual indicator whenever the temperature in the electric panel exceeds the upper temperature limit, including during the override period.

21. The improvement of claim 20, wherein the microprocessor continuously activates the audible alarm for a continuous initial period immediately after the temperature in the cabinet exceeds the upper temperature limit and activates the audible alarm in the series of sound pulses each separated by the silence interval after the initial period.

22. In a battery operated alarm including an alarm output device for providing an alarm output indicative of an alarm condition, the improvement comprising a control arrangement interconnected with the alarm output device for providing intermittent actuation of the alarm output device, wherein the control arrangement is operable to increase the interval between actuations of the alarm output device responsive to the duration of the alarm condition.

* * * * *

UNITED STATES PATENT AND TRADEMARK OFFICE

CERTIFICATE OF CORRECTION

PATENT NO: 5,929,762

DATED: July 27, 1999

INVENTORS: Richard S. Missimer

It is certified that error appears in the above-identified patent and that said Letters Patent are hereby corrected as shown below:

Title page,

In [75] Inventor:

Delete "Richard S. Missimer, Jr." and substitute therefor ---Richard S. Missimer---.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*